United States Patent [19]

Aoyama

[11] 4,450,747

[45] May 29, 1984

[54] MUFFLER ASSEMBLY FOR A PIANO

[75] Inventor: Kikuro Aoyama, Shizuoka, Japan

[73] Assignee: Nippon Gakki Seizo Kabushiki Kaisha, Japan

[21] Appl. No.: 358,681

[22] Filed: Mar. 16, 1982

[30] Foreign Application Priority Data

Mar. 19, 1981 [JP] Japan ..... 56-038416[U]

[51] Int. Cl.[3] ..... G10C 3/26

[52] U.S. Cl. ..... 84/220; 84/216

[58] Field of Search ..... 84/220, 216, 219

[56] References Cited

U.S. PATENT DOCUMENTS 523,092 7/1894 Weser ..... 84/220

912,294 2/1909 Dawson ..... 84/220

FOREIGN PATENT DOCUMENTS 341926 8/1904 France ..... 84/220

*Primary Examiner*—Lawrence R. Franklin

*Attorney, Agent, or Firm*—Lerner, David, Littenberg, Krumholz & Mentlik

[57] ABSTRACT

In the construction of a muffler assembly for a piano, a muffler rail is supported for up and down movement along a substantially straight path slightly inclined sideways for unchanged correct positioning of a muffler felt between strings and hammers even after long use, thereby assuring constant sound softening.

4 Claims, 6 Drawing Figures

MUFFLER ASSEMBLY FOR A PIANO

BACKGROUND OF THE INVENTION

The present invention relates to an improved muffler assembly for a piano.

In the construction of a conventional upright piano, a muffler rail holding a muffler felt is operationally coupled to a soft pedal by intermediate links and driven, when the soft pedal is stepped on by the player, for causing a swinging motion in order to place the muffler felt between strings and associated hammers for reducing the volume of sound.

Due to this swingable construction, the muffler rail is kept inclined with respect to the vertical direction during normal performance. This inclined stand-by position of the muffler rail tends to cause inevitable buckling of the muffler felt whilst resulting in formation of an abnormally large gap between the muffler felt and the strings. Presence of such an enlarged gap results in fluctuations in muffling effect and serious disturbance on key touch on the player's fingers. The swingable construction of the muffler rail further causes complicated mounting and adjustment of the muffler assembly and complicated construction which necessitates the use of bearings.

This large gap trouble may occur in the case of an electric piano in which a number of metallic circular members are arranged side by side on a muffler felt and corresponding hammers are arranged each facing an associated circular member so that the sound generated by the metallic member stricken by an associated hammer should electrically be picked up for cembalo effect.

As is clear from the following description, the idea of the present invention is fairly applicable to both the muffling device of ordinary pianos and the cembalo effect producing device of electric piano.

SUMMARY OF THE INVENTION

It is the object of the present invention to exclude the swing motion of the muffler rail in operation of the muffler assembly for constant sound softening effect, easier mounting and adjustment and simpler construction.

In accordance with the basic aspect of the present invention, a muffler rail is supported at its both ends by a pair of opposite guide blocks, each guide block is provided with a substantially vertical slot which is formed in a plane parallel to the muffler and extends with a slight inclination with respect to the vertical direction, and the vertical slot is in slidable engagement with a projection formed on the associated end of the muffler rail so that, when operated by the soft pedal, the muffler rail will move up and down almost straightly.

DESCRIPTION OF THE PREFERRED EMBODIMENTS

Figure 1A:
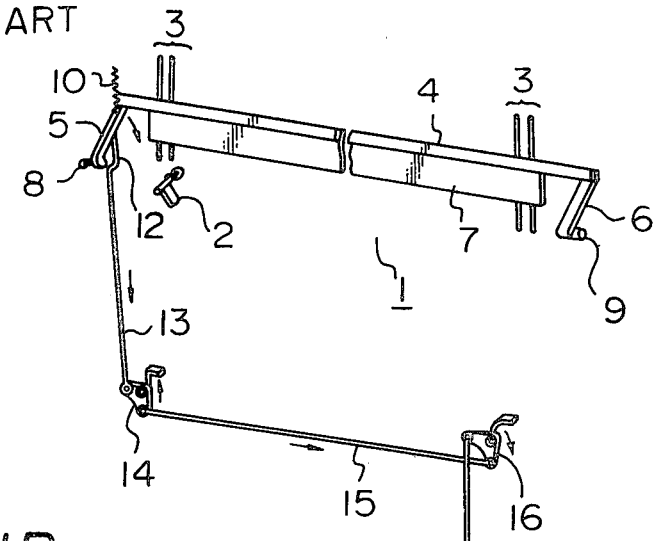
Fig. 1A PRIOR ART
FIG. 1A is a perspective view of a conventional muffler assembly.
Figure 1B:
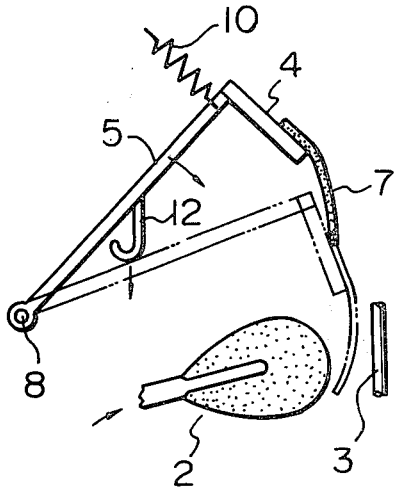
Fig. 1B PRIOR ART
FIG. 1B is an enlarged side view of its major operational part.

The construction in general of a conventional muffler assembly for sound softened performance on an upright piano is shown in FIGS. 1A and 1B, in which the muffler assembly 1 includes a muffler rail 4 horizontally extending over all strings 3 which are arranged vertically on the backside of associated hammers 2. The muffler rail 4 is supported at its lateral ends by a pair of muffler arms 5 and 6 and provided on its lower face with a muffler felt 7 which is commonly operable on all the strings 3.

Muffler arm pins 8 and 9 are mounted to both side boards (not shown) of the piano in order to pivotally support the distal ends of the associated muffler arms 5 and 6. One of the muffler arms, i.e. the left side muffler arm 5 in the case of the illustrated example is biased upwards by a muffler spring 10 so that the muffler felt 7 should be kept at a position above the hammers 2. The left side muffler arm 5 is coupled to a muffler link 13 by means of a muffler arm hook 12 and the lower end of the muffler link 13 is pivotally coupled, by means of a link 14, to a muffler link 15 which almost horizontally extends rightwards. The right end of the muffler link 15 is pivotally coupled, by means of a muffler link lever 16, to a muffler link 17 which further extends downwards for connection with a soft pedal 18.

As the soft pedal 18 is stepped on by the player of the piano, the above-described three muffler links 13, 15 and 17 move in the directions shown with arrows in the illustration. The downward movement of the first muffler link 13 causes the muffler arm 5 to swing downwards about the associated muffler arm pin 8 against tension by the muffler spring 10. As a consequence, the muffler felt 7 moves downwards with the muffler rail 4 in order to be located between the hammers 2 and the strings 3. When any key in the keyboard is operated under this condition, the associated hammer 2 strikes the corresponding string 3 via the muffler felt 7. This indirect striking naturally enfeebles vibration of the stricken string 3 for generation of a softened or muffled musical tone.

With the above-described construction of the muffler assembly 1 for sound softened performance, the muffler arms 5 and 6 are kept at a position of about 45 degrees inclination during normal performance and, as a consequence, the face of the muffler rail 4 intersects a vertical plane at a cross angle of about 45 degrees. As briefly described already, this inclined arrangement of the muffler rail 4 causes, after long use, the lower section of the muffler felt 7 to buckle in a vertical direction as shown in FIG. 1B. When the muffler felt 7 in this buckling state is located between the hammers 2 and the strings 3 for sound softened performance, a relatively large gap is left between the muffler felt 7 and the strings 3. Presence of such an excessive gap makes the hammer 2 strike the muffler felt 7 earlier than it should be, thereby causing fluctuation in sound softening effect and ill touch on the players fingers.

Further as also briefly mentioned already, the muffler arms 5 and 6 on the muffler rail 4 are driven for swing motion about their pivots 8 and 9. Complicated work is required for correct mounting and adjustment of the muffler arms 5 and 6 for smooth and stable swing motion. In addition, only one of the muffler arms, i.e. the left side muffler arm 5 in the illustrated example, is biased by the muffler spring 10 and such unbalanced force application tends to cause unstable behaviour of the other of the muffler arms, i.e. the right side muffler arm 6 in the illustrated example. Swing motion of the muffler arms 5 and 6 may further cause a trouble that they bump other elements of the piano such as the frame and the action assembly.

Figure 2:
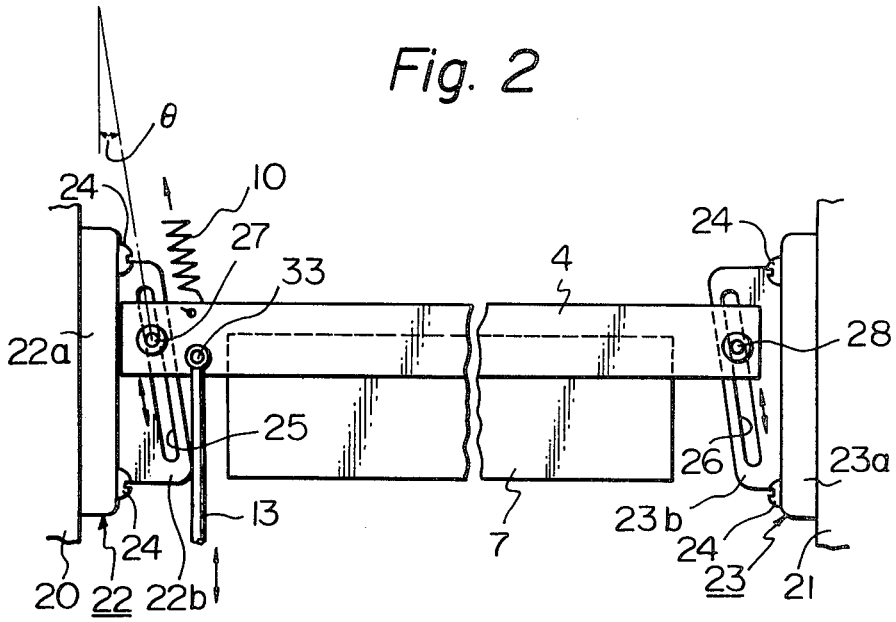
FIG. 2 is a front view of one embodiment of the muffler assembly in accordance with the present invention.
Figure 3:
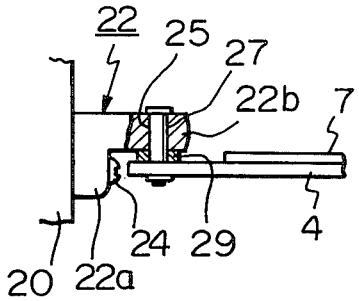
FIG. 3 is a plan view, partly in section, of its major part.

One embodiment of the present invention is shown in FIGS. 2 and 3, in which elements substantially similar in construction and operation to those used for the conventional construction shown in FIGS. 1A and 1B are designated with similar reference numerals.

Left and right side boards 20 and 21 are accompanied with guide blocks 22 and 23 secured to their inside surfaces at corresponding positions. More specifically, the guide blocks 22 and 23 are formed into L-or T-shaped blocks and the base sections **22*a* and 23*a* are secured to the inside surfaces of the side boards 20 and 21 by means of set screws 24. Opposite extensions 22*b* and 23*b* are provided with inclined guide slots 25 and 26 in parallel to each other. The center lines of the guide slots 25 and 26** intersect vertical planes at a cross angle $\theta$ preferably in a range from 10 to 14 degrees.

The muffler rail 4 is provided at its lateral end sections with pins 27 and 28 which are slidably received within the associated guide slots 25 and 26 of the guide blocks 22 and 23 and blocked against falling-out by suitable bushes 29. Thanks to this construction, the muffler rail 4 is able to move up and down within the range of the guide slots 25 and 26. It is also employable for easier mounting of the muffler rail 4 to make the guide slots 25 and 26 open in the upper ends of the extensions **22*b* and 23*b* of the guide blocks 22 and 23**.

Figure 4:
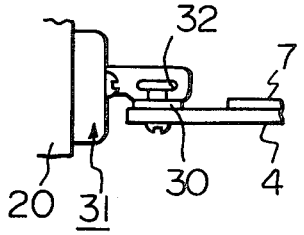
FIGS. 4 and 5 are plan and sectional views of the major parts of the other embodiments of the pedal assembly in accordance with the present invention.

As a substitute for the pins 27 and 28 shown in FIG. 2, a slide piece 30 of substantially I-shaped cross section may be secured to each end of the muffler rail 4 as shown in FIG. 4 and a T-shaped guide groove 32 may be formed in a guide block 31 secured to the side board 20 in order to slidably receive the slide piece 30 on the muffler rail 4.

In a further modification, similar slide pieces may be formed on the guide blocks in engagement with similar guide grooves formed in the ends of the muffler rail 4.

One end section of the muffler rail 4, i.e. the left end section of the muffler rail 4, is coupled to a muffler spring 10 whose tension pulls the muffler rail 4 upwards. However, the muffler spring 10 may be coupled to the right end section of the muffler rail 4 when the guide slots 25 and 26 incline rightwards. In other words, the coupling position of the muffler spring 10 is chosen in accordance with the direction of inclination of the guide slots 25 and 26 for smooth up and down movement of the muffler rail 4. The top end of the first muffler link 13 is pivoted to the similar end section of the muffler rail 4 by means of a pin 33 mounted to the muffler rail 4. As in the conventional construction, when the soft pedal 18 is stepped on, the muffler rail 4 is pulled downwards by the descending muffler link 13 against the tension of the muffler spring 10 in order to interpose the muffler felt 7 between the hammers 2 and the strings 3.

Since the muffler rail 4 is supported stably at both ends by a pair of opposite guide blocks 22 and 23 and the muffler rail 4 is kept vertical even at its stand-by position during normal performance, the muffler felt 7 never buckles with respect to the muffler rail 4. As a consequence, no fluctuation in sound softening effect is caused even after long use without any special care. Constant gap between the muffler felt 7 and the strings 3 assures constant key touch on the player's fingers. Inclined construction of the guide slots 25 and 26 stably controls up and down movement of the muffler rail 4 and absence of the swing motion of the elements supporting the muffler rail 4 results in earlier mounting and simpler construction without use of bearings.

It was further confirmed that the inclined arrangement of the guide slots or grooves imposes a slight frictional resistance against the up and down movement of the muffler rail and presence of such resistance rather stabilizes the movement of the muffler rail.

Figure 5:
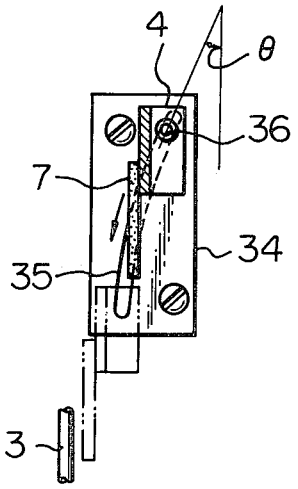

A further embodiment of the muffler assembly in accordance with the present invention is shown in FIG. 5, in which a guide block 34 is provided with an arcuate guide groove 35. The curvature of the guide groove 35 is slightly convex on the string side. In this case also, the muffler rail 4 is allowed to maintain the substantially vertical position during its up and down movement. It should be noted in the case of this embodiment that the guide grooves 35 are formed in planes, i.e. the guide blocks 34, parallel to the inside surfaces of the side boards 20 and 21 and, as a consequence, pins 36 should extend sideways from the end faces of the muffler rail 4.

I claim:

1. A muffler assembly for a piano having a plurality of hammers arranged side by side in a row, said muffler assembly comprising a muffler rail horizontally extending along said row of said hammers and having a projection formed at each end of said muffler rail, a muffler felt coupled to and hanging downward from said muffler rail, a pair of guide blocks mounted to said piano, each of said guide blocks facing one end of said muffler rail and provided with a guide slot which is located in a vertical plane parallel to said muffler rail, each of said guide slots extending with a slight inclination with respect to the vertical direction and adapted for slidable engagement with one of said projections formed on said ends of said muffler rail, urging means for resiliently urging said muffler rail to move upwards, and intermediate links coupling said muffler rail to a soft pedal of said piano so that, when said soft pedal is stepped on, said muffler rail is pulled downwards against the operation of said urging means in order to place said muffler felt in front of said hammers.

2. The muffler assembly as claimed in claim 1 in which the angle of inclination of said slots is in a range of from 10 to 14 degrees.

3. The muffler assembly as claimed in claim 1 in which the horizontal distance between said muffler felt and said row of hammers remains the same during the vertical movement of said muffler rail.

4. The muffler assembly as claimed in claim 1 in which said urging means urges said muffler rail to move in the direction of said slots.

* * * * *